US007013848B2

(12) United States Patent
Gentil-Kreienkamp et al.

(10) Patent No.: US 7,013,848 B2
(45) Date of Patent: Mar. 21, 2006

(54) METHOD AND DEVICE FOR REGULATING THE TEMPERATURE OF A COOLANT OF AN INTERNAL COMBUSTION ENGINE

(75) Inventors: Isabelle Gentil-Kreienkamp, Bietigheim-Bissingen (DE); Holger Huelser, Graz (AT); Jim Odeskog, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/520,887

(22) PCT Filed: Jun. 12, 2003

(86) PCT No.: PCT/DE03/01964

§ 371 (c)(1),
(2), (4) Date: Jan. 11, 2005

(87) PCT Pub. No.: WO2004/016920

PCT Pub. Date: Feb. 26, 2004

(65) Prior Publication Data

US 2005/0224018 A1 Oct. 13, 2005

(30) Foreign Application Priority Data

Jul. 16, 2002 (DE) ..... 102321507

(51) Int. Cl.
*F01P 7/14* (2006.01)

(52) U.S. Cl. ..... 123/41.1

(58) Field of Classification Search ..... 123/41.1, 123/41.12, 41.44

See application file for complete search history.

(56) References Cited

U.S. PATENT DOCUMENTS

2001/0020452 A1 9/2001 Suzuki et al.

FOREIGN PATENT DOCUMENTS

DE 41 09 498 9/1992
DE 199 51 362 5/2001

*Primary Examiner*—Noah P. Kamen
*Assistant Examiner*—Katrina Harris
(74) *Attorney, Agent, or Firm*—Kenyon & Kenyon LLP

(57) ABSTRACT

A method for regulating the temperature of a coolant of an internal combustion engine, including a temperature sensor detecting the temperature of the coolant and a first control unit controlling and/or regulating the coolant temperature to obtain a predetermined temperature setpoint value, a further control unit being provided whose signals are fed to the first control unit, the further control unit relaying signals about an established driver type to the first control unit and, depending on whether the driver type is classified as sporty or economical, the first control unit presetting the temperature setpoint value, in which a coolant volume flow for cooling the internal combustion engine is regulated or controlled by the control unit as a function of the driver type established.

21 Claims, 1 Drawing Sheet

METHOD AND DEVICE FOR REGULATING THE TEMPERATURE OF A COOLANT OF AN INTERNAL COMBUSTION ENGINE

FIELD OF THE INVENTION

The present invention relates to a method for regulating the temperature of a coolant of an internal combustion engine, a temperature sensor detecting the temperature of the coolant and a first control unit controlling and/or regulating the coolant temperature in order to obtain a predetermined temperature setpoint value, a further control unit being provided whose signals are fed to the first control unit, the further control unit relaying signals about an established driver type of the motor vehicle to the first control unit and, depending on whether the driver type is classified as economical or sporty, the first control unit presetting the temperature setpoint value.

Furthermore, the present invention relates to a device, such as for a motor vehicle having an internal combustion engine and a cooling device, including a control unit for controlling and/or regulating a setpoint temperature value of a coolant, and a temperature sensor for measuring the actual temperature value, and a valve for setting a coolant volume flow to a radiator and/or to the internal combustion engine, a second control unit being provided which works together with the first control unit in order to relay information in regard to the driver type, including a sporty or economical driver type, to the first control unit and, on the basis of this information, a temperature setpoint value being determinable by the first control unit.

BACKGROUND INFORMATION

German Published Patent Application No. 199 51 362 discusses a method for regulating the cooling water temperature, a temperature sensor detecting the cooling water temperature and a control unit for the cooling water temperature actuating at least one valve and/or one fan in order to obtain a predetermined temperature setpoint value of the cooling water, a further sensor and/or an engine or vehicle control unit being provided whose signals are fed to the first control unit, the first control unit determining a temperature setpoint value therefrom. The determination of the setpoint value may be predetermined as a function of the driver type, a driver who drives sportily or economically, for example.

In this manner, the exhaust gas value and the fuel consumption may be optimized and/or minimized.

Furthermore, German Published Patent Application No. 41 09 498 discusses regulating the temperature of an internal combustion engine so that different temperature setpoint value ranges are used for the temperature regulation on the basis of different operating conditions. In particular, operating parameters of the internal combustion engine, among other things switching on of auxiliary systems and malfunctions of the internal combustion engine, may be cited as operating conditions. The setpoint value of the cooling water temperature may be set depending on which priority the different operating conditions have.

SUMMARY OF THE INVENTION

The present invention relates to an exemplary method and an exemplary device for regulating the temperature of an internal combustion engine to reduce the fuel consumption further, including, for example, for an economical driver, without performance losses being noticeable for a sporty driver, and to reduce the emissions overall.

The present invention may provide an exemplary method and/or device in which the volume flow of the coolant for cooling the internal combustion engine is regulated and/or controlled by the control unit as a function of the driver type established.

The efficiency of an internal combustion engine cooled using a coolant may be increased in the part-load range if the temperature of this coolant is elevated above the currently mostly set value of 95° Celsius, to a range of 105°–115° Celsius. In the full-load range, however, the temperature of the coolant may be required to be lowered again in order to limit damage to the internal combustion engine and/or performance losses. An exemplary method thus may provide temperature regulation of the engine using higher temperatures in part-load operation and lower temperatures in full-load operation, using which the problem of knocking and/or performance losses in the transition from part-load to full-load operation may be minimized.

The driver type may be included in the operating parameters which the exemplary method may use for control. According to an exemplary method for determining the driver type, a sporty driver type may be determined if frequent and rapid load changes are performed and an economical driver type may be concluded in the event of infrequent and slow load changes.

If the quantity of the coolant that flows to the internal combustion engine, i.e., the coolant volume flow, is also made a function of the driver type, the danger of local overheating at especially hot points of the cylinder head, which may arise in the event of a strong and sudden elevation of the engine load, for example, may also be avoided still.

In this instance, for example, the exemplary method may assign a relatively low coolant volume flow to an economical driver type, such as, for example, in part-load operation. Thus, little energy may be required for circulating the coolant and the desired temperature may be achieved more rapidly even in the warmup phase of the engine. Both parameters may have a desired effect on the fuel consumption.

If a rapid and strong load elevation nonetheless occurs, a higher coolant volume flow may be required to be first achieved before the coolant may dissipate the waste heat of the engine, which may now be strongly increased. Therefore, if it is to be expected that rapid and strong load elevations will occur, since, for example, the driver type is rather sporty, the exemplary method may initially assign this driver type a higher coolant volume flow than an economical driver type (even in part-load operation). Therefore, if a rapid and strong load elevation occurs, a volume flow sufficient to reliably dissipate the waste heat may be immediately available. A higher coolant volume flow of this type and therefore also an elevated fuel consumption may be more acceptable for a sporty driver.

Furthermore, the coolant temperature may be controlled and/or regulated between an upper and a lower limiting value by the control unit. In particular, 95° Celsius may be used as the lower limiting value, and a value between 105 and 115° Celsius may be used as the upper limiting value.

In this instance, it may be provided that temperatures outside these temperature limits are not approached.

For the determination of the driver type, only a selection between an economical and a sporty driver type may be provided. However, intermediate values may also be fixed, these values being determinable continuously or in discrete steps. Intermediate values may then also be set between the two limiting values previously cited in this instance. For this purpose, a digital selector switch between "sporty" and "economical" may thus be provided. However, the selector switch may also approach multiple intermediate steps.

According to a first exemplary embodiment, the coolant temperature may lie closer to the upper limiting value the more the driver type is classified as the economical driver type. In this instance, such as in part-load operation, a higher cooling water temperature may be set for the economical driver type than for the sporty driver type. For intermediate values, the coolant temperature may be set lower the closer this intermediate value is to the sporty driver type. The exemplary method may provide a desired result when it is implemented for part-load. The exemplary method according to the present invention may thus assign a lower coolant temperature setpoint value to a sporty driver type than to an economical driver type, even for part-load operation of the engine. The coolant temperature may thus be closer to the lower limiting value, such as in part-load operation, the more the driver type is classified as the sporty driver type. In this manner, for a sporty driver type, the danger of performance loss upon changing from part-load operation to full-load operation is lower, even if this is at the price of elevated fuel consumption. Because of the elevated coolant temperature in part-load operation, the economical driver type may achieve lower fuel consumption, which may be, however, connected with a higher risk of performance loss in the transition from part-load operation to full-load operation. In this instance, even for the economical driver type, a shift in the direction of the upper limiting value may only be provided when the internal combustion engine is operated in part-load operation.

For example, for the sporty driver type, no shift in the direction of the upper limiting value may occur, even for part-load operation of the internal combustion engine. It may be more acceptable for a sporty driver type to tolerate this lower cooling water temperature and therefore the elevated fuel consumption, instead of the performance loss.

For example, in the exemplary method according to the present invention it may be provided that the sporty driver is assigned a higher coolant flow, at least in part-load operation, than the economical driver type. Because of this assignment, the danger of local overheating at especially hot points in the cylinder head, as may otherwise arise in the event of a strong and rapid increase of the engine load, may be reduced for a sporty driver. However, an elevated fuel consumption may be achieved, since more coolant may be circulated.

The economical driver type may be assigned a lower coolant volume flow only in part-load operation, and the coolant flow for the sporty and the economical drivers may be identical in full-load operation.

For example, there may be no adaptation of the coolant volume flow for the sporty driver type even in part-load operation, i.e., the coolant volume flow for the sporty driver may always be equally high.

In this manner, performance losses and the danger of overheating of the engine may be prevented better.

In addition, an exemplary embodiment of the present invention may relate to a control unit of an internal combustion engine, such as, for example, for a motor vehicle, on which a program may be stored, which may be executable on a computing device, including, for example, a microprocessor, and may be capable of executing an exemplary method as described above.

Furthermore, the present invention may relate to an exemplary device for a motor vehicle having an internal combustion engine, whereby the internal combustion engine may include a control and/or regulating unit as described above.

The control unit which may be used as the second control unit may be the electronic engine control unit.

Further advantages and features of the present invention may result from the remaining documents of the application. The features may be essential for the present invention individually or in any arbitrary combination with one another.

In the following, the present invention is to be described in greater detail on the basis of an exemplary embodiment. The exemplary embodiment is illustrated in the drawing.

DETAILED DESCRIPTION

Figure 1:
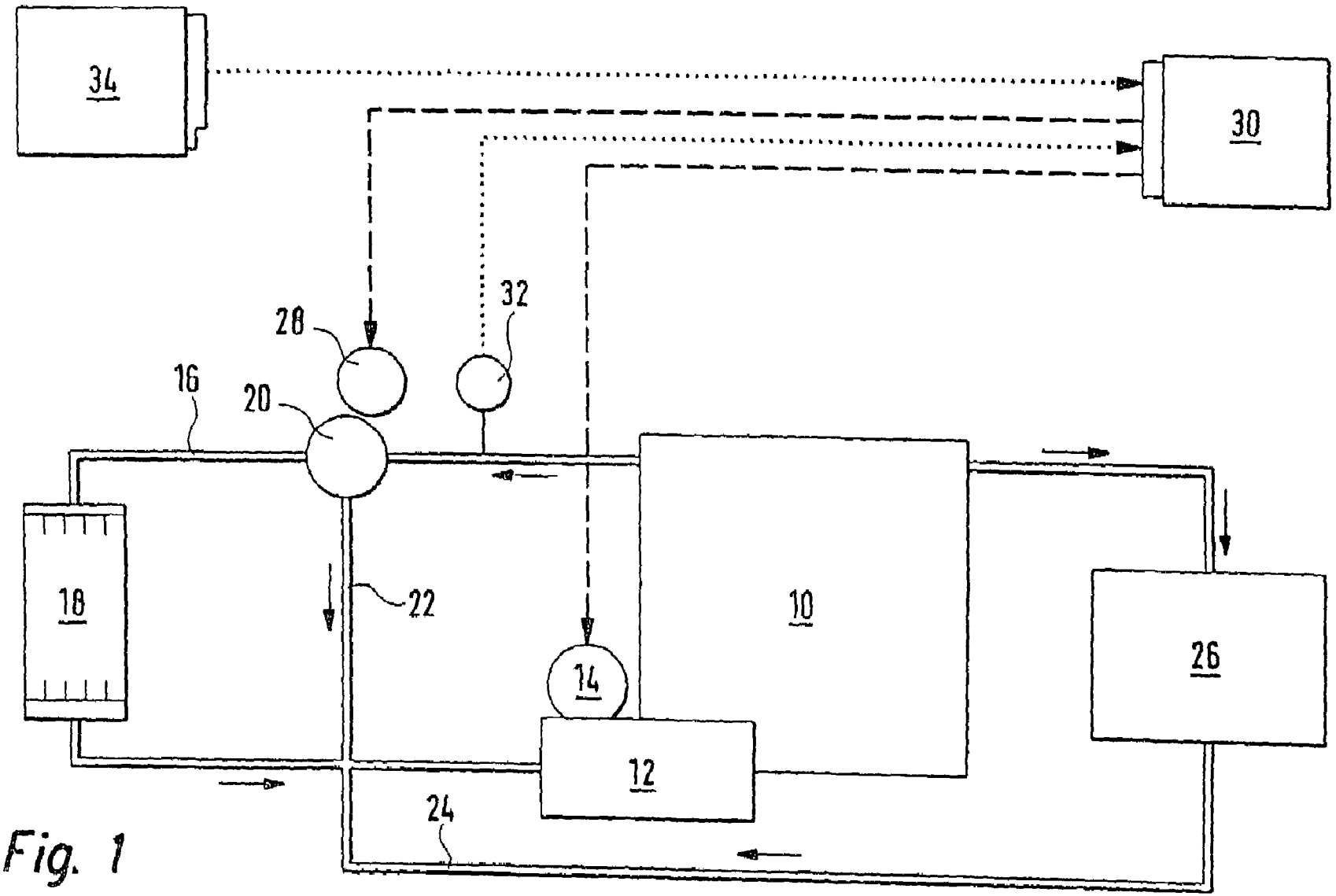
FIG. 1 shows a schematic circuit diagram of an exemplary cooling circuit of an internal combustion engine.

The internal combustion engine includes an internal combustion engine 10 and a coolant pump 12, which may pump the coolant through a cooling circuit for cooling internal combustion engine 10. In this instance, coolant pump 12 may either be driven directly by the crankshaft of internal combustion engine 10 via a belt or it may be an electrically driven coolant pump.

Coolant pump 12 is connected to a device for varying coolant volume flow 14. In particular, if coolant pump 12 is an electrical coolant pump, the variation of the volume flow may be simple to perform.

Via a coolant line 16, either all or part of the coolant may flow via a radiator 18 and thus may be cooled.

Via a thermostat valve 20 and a bypass line 22, coolant may flow past radiator 18. A bypass line 22 of this type may optionally be provided.

Via a further coolant line 24, coolant from internal combustion engine 10 is conducted from the internal combustion engine via a heater heat exchanger 26 to coolant pump 12. A passenger compartment may be heated via heater heat exchanger 26, for example.

In this instance, thermostat valve 20 may be actuated by an electronic first control unit 30 via an actuator 28. Depending on the position of valve 20, a larger or smaller part of the coolant volume flow flows via radiator 18 and is cooled. By mixing coolant which was cooled via the radiator and coolant which flows via bypass line 22 and/or heater heat exchanger 26, the temperature of the coolant at the intake of internal combustion engine 10 may be set by electronic control unit 30.

In addition, at least one temperature sensor 32 may be provided in the cooling circuit, via which control unit 30 may determine the temperature of the coolant, i.e., the actual temperature.

In addition, a second electronic control unit 34 may be provided, which may be the engine control unit in this instance. This second control unit 34 determines a driver type in the range between economical and sporty from an available related method, such as, for example, for transmission control. In this instance, a finite number of intermediate values, which may also be set, may be provided between these two values. Control unit 34 analyzes the position of a selector switch (not shown) for this purpose.

Second electronic control unit 34 has a data link to first electronic control unit 30, via a CAN bus, for example, in this instance.

Alternatively, the first and the second control unit may also be implemented in one single control unit.

To reduce the fuel consumption, improve the emissions, and nonetheless obtain a satisfactory performance distribution, and to reduce the tendency to knock, the coolant temperature may be influenced depending on whether the driver is sporty or economical.

For this purpose, a corresponding control program for performing an exemplary method according to the present invention may be stored in control unit 30. Through the exemplary method, valve 20 is opened and closed via actuator 28. By changing the position of valve 20, the temperature of the coolant may be varied, since the flow of the coolant which flows via radiator 18 may be varied in this manner. In this instance, besides the other operating parameters of the internal combustion engine, the control program may also take the driver type determined in control unit 34 into consideration. The control program in control unit 30 actuates valve 20 via actuator 28 in this instance so that, at least for some values of the operating parameters of the internal combustion engine, a different, such as, for example, a lower value of the coolant temperature may be set for a sporty driver type than for an economical driver type. If there is an intermediate value of the driver type between "sporty" and "economical," the coolant temperature may be set lower for this intermediate value of the driver type the closer this intermediate value is to the driver type "sporty."

For example, a lower value of the coolant temperature may be set for a sporty driver than for an economical driver for the operating parameter "part-load" of the internal combustion engine. For intermediate values, the statement above may apply. For example, it may be provided that for a sporty driver, also for part-load operation, no higher value of the coolant temperature may be set than is the case for full-load, while for an economical driver type a higher value of the coolant temperature may be set for part-load than is the case for full-load. Thus, for example, for an economical driver type, the temperature in part-load operation may be raised to 105°–115° Celsius as the upper limiting value and the coolant temperature may only be reduced to 95° Celsius in full-load operation in order to limit damage to the internal combustion engine and/or performance losses. However, the efficiency of internal combustion engine 10 may be increased by increasing the coolant temperature.

In addition, according to an exemplary embodiment of the present invention, besides varying the coolant temperature as a function of the driver type, the volume flow of the coolant may also be varied by control unit 30 via device 14 as a function of the driver type. In this instance, the control program in control unit 30 may assign a relatively low coolant volume flow to an economical driver type, such as, for example, in part-load operation. Thus, little energy may be required for circulating the coolant and the engine may reach the desired temperature more rapidly in the warmup phase. A lower fuel consumption may thus be achieved.

If rapid and strong load elevation occurs, however, a higher coolant volume flow may be required to be first achieved before the coolant may dissipate the waste heat of the engine, which may be now strongly increased. Therefore, the control program in control unit 30 assigns a higher coolant volume flow to a sporty driver, such as, for example, in part-load operation, than to an economical driver type. In this manner, a sufficient coolant flow to ensure heat dissipation reliably and prevent damage to internal combustion engine 10 may be available for a sporty driver type. Since a sporty driver type may be distinguished by frequent and rapid load changes, the elevated coolant volume flow of this type may be appropriate. The elevated fuel consumption connected therewith may be accepted. For example, for the sporty driver, even for part-load, a lower value of the coolant quantity than is the case for full-load may not be set.

For intermediate values of the driver type which lie between "sporty" and "economical," the volume flow may be set lower for identical load the closer the driver type lies to economical.

The driver type may be determined, for example, in that a sporty driver type is concluded in the event of frequent and rapid load changes and an economical driver type may be concluded in the event of infrequent and slow load changes.

What is claimed is:

1. A method for regulating a temperature of a coolant of an internal combustion engine, comprising:

detecting, by a temperature sensor, a temperature of the coolant;

at least one of controlling and regulating, by a first control unit, the coolant temperature to obtain a predetermined temperature setpoint value;

one of feeding and relaying signals of a further control unit about an established driver type to the first control unit;

presetting, by the first control unit, the temperature setpoint value, depending on whether the established driver type is classified as one of a sporty driver type and an economical driver type; and one of regulating and controlling, by the first control unit, a coolant volume flow for cooling the internal combustion engine as a function of the established driver type.

2. The method of claim 1, wherein at least one of the coolant temperature and the coolant volume flow is at least one of controlled and regulated between an upper and a lower limiting value by the first control unit.

3. The method of claim 1, wherein the driver type is one of an arbitrary setting and a discrete intermediate setting between the sporty driver type and the economical driver type.

4. The method of claim 2, wherein the coolant temperature lies closer to the upper limiting value the more the established driver type is classified as the economical driver type.

5. The method of claim 2, wherein the coolant temperature lies closer to the lower limiting value the more the established driver type is classified as the sporty driver type.

6. The method of claim 2, further comprising:

only shifting the temperature setpoint value in a direction of the upper limiting value if the internal combustion engine is operated in part-load operation.

7. The method of claim 2, wherein for the sporty driver type, the temperature setpoint value is not shifted in a direction of the upper limiting value even in the event of part-load operation of the internal combustion engine.

8. The method of claim 1, wherein for the economical driver type, a lower coolant volume flow is set at least in part-load operation than for full-load operation.

9. The method of claim 1, wherein, at least in part-load operation, a higher coolant volume flow is set for the sporty driver type than for the economical driver type.

10. The method of claim 1, wherein a lower coolant volume flow in part-load operation than for full-load operation is not set for the sporty driver type.

11. A control unit of an internal combustion engine, on which a program is stored, which is executable on a computing device and capable of executing the steps of:

detecting, by a temperature sensor, a temperature of the coolant;

at least one of controlling and regulating, by a first control unit, the coolant temperature to obtain a predetermined temperature setpoint value;

one of feeding and relaying signals of a further control unit about an established driver type to the first control unit;

presetting, by the first control unit, the temperature setpoint value, depending on whether the established driver type is classified as one of a sporty driver type and an economical driver type; and one of regulating and controlling, by the first control unit, a coolant volume flow for cooling the internal combustion engine as a function of the established driver type.

12. The control unit of claim 11, wherein the control unit is operable for an internal combustion engine of a motor vehicle.

13. The control unit of claim 11, wherein the computing device includes a microprocessor.

14. A device, comprising:

an internal combustion engine;

a cooling device including:

a device to set a coolant volume flow to at least one of a radiator and the internal combustion engine;

a temperature sensor to measure an actual temperature value;

a first control unit to, on a basis of a specified driver type, determine a temperature setpoint value of a coolant, at least one of control and regulate the setpoint temperature value, and vary the coolant volume flow; and a second control unit to work together with the first control unit to specify the driver type, wherein the specified driver type is one of a sporty driver type, an economical driver type, and an intermediate value.

15. The device of claim 14, wherein the device is operable in a motor vehicle.

16. The device of claim 14, further comprising:

a radiator;

a bypass line; and a valve to control a coolant volume flow via at least one of the radiator and the bypass line, depending on a temperature to be set.

17. The device of claim 14, wherein the second control unit includes an electronic engine control unit.

18. The device of claim 14, further comprising:

a coolant pump to circulating the coolant volume flow.

19. The device of claim 18, wherein the coolant pump includes an electronic coolant pump.

20. The device of claim 14, wherein the first and second control units are arranged as a single control unit.

21. The device of claim 14, wherein the control unit includes a stored program and a computing device to execute the stored program to perform the operations of the first and second control units.

* * * * *